US011375602B2

(12) United States Patent
Mezei

(10) Patent No.: US 11,375,602 B2
(45) Date of Patent: Jun. 28, 2022

(54) NEUTRON SOURCE AND METHOD OF PRODUCING A NEUTRON BEAM

(71) Applicant: Mirrotron KFT, Budapest (HU)

(72) Inventor: Ferenc Mezei, Budapest (HU)

(73) Assignee: MIRROTRON KFT, Budapest (HU)

( * ) Notice: Subject to any disclaimer, the term of this patent is extended or adjusted under 35 U.S.C. 154(b) by 25 days.

(21) Appl. No.: 16/978,393

(22) PCT Filed: Mar. 5, 2019

(86) PCT No.: PCT/HU2019/050006
§ 371 (c)(1),
(2) Date: Sep. 4, 2020

(87) PCT Pub. No.: WO2019/171092
PCT Pub. Date: Sep. 12, 2019

(65) Prior Publication Data

US 2021/0051795 A1 Feb. 18, 2021

(30) Foreign Application Priority Data

Mar. 6, 2018 (HU) ..... P1800080

(51) Int. Cl.

| | |
|---|---|
| ***H05H 3/06*** | (2006.01) |
| ***G21G 4/02*** | (2006.01) |
| ***G21G 1/06*** | (2006.01) |
| ***H05H 6/00*** | (2006.01) |

(52) U.S. Cl.
CPC ..... *H05H 3/06* (2013.01); *G21G 1/06* (2013.01); *G21G 4/02* (2013.01); *H05H 6/00* (2013.01); *H05H 2277/11* (2013.01)

(58) Field of Classification Search
CPC .. G21G 4/02; G21G 4/00; G21G 4/06; G21G 4/08; G21G 1/0005; G21G 1/001; G21G 1/04; G21G 1/00; H05H 6/00; H05H 2277/00; H05H 2277/10; H05H 2277/11; H05H 2277/116; H05H 2277/13; H05H 3/00; H05H 3/06; H05H 9/00;
(Continued)

(56) References Cited

U.S. PATENT DOCUMENTS

2017/0223815 A1* 8/2017 Yamamoto ..... G21G 4/02

FOREIGN PATENT DOCUMENTS

RU 2238545 C2 * 10/2004 ..... G01N 23/222

* cited by examiner

*Primary Examiner* — Darlene M Ritchie
(74) *Attorney, Agent, or Firm* — Olson & Cepuritis, Ltd.

(57) ABSTRACT

The object of the invention relates to a neutron source, which contains a proton accelerator for producing a proton beam, and a target arranged in the trajectory of the proton beam exiting the proton accelerator for producing a neutron beam, to which the proton beam arrives in long, typically 0.5 ms-3 ms impulses, and contains a moderator-reflector system arranged in the vicinity of the target and serving for producing a moderated neutron beam, which has at least one moderator, and a reflector surrounding the moderator and the target, characterized by that at least one statistical neutron chopper is arranged to protrude into the at least one moderated neutron beam exiting channel that modulates at least one neutron beam intensity according to a random or pseudo-random sample as a function of time with its neutron transmittance ability varying according to such pattern.

16 Claims, 4 Drawing Sheets

(58) Field of Classification Search
CPC ..... A61N 2005/109; A61N 2005/1087; G21C 7/34; G21C 23/00
USPC ..... 376/156, 158, 190–194
See application file for complete search history.

NEUTRON SOURCE AND METHOD OF PRODUCING A NEUTRON BEAM

CROSS-REFERENCE TO RELATED APPLICATIONS

This application is a U.S. National Stage of PCT/HU2019/050006, filed Mar. 5, 2019, which claims priority to Hungarian Application No. P1800080, filed Mar. 6, 2018, each of which is incorporated herein by reference.

The object of the invention relates to a neutron source, which contains a first proton accelerator for producing a first proton beam having a first energy and a first target for producing a first neutron beam, which first target is connected to the first proton accelerator by a first beam trajectory, and at least one first neutron beam channel guiding the neutrons exiting the first target.

The object of the invention also relates to a method for the use of such a neutron source.

The object of the invention also relates to a neutron source, which contains a proton accelerator for producing a proton beam, and a target arranged in the trajectory of the proton beam exiting the proton accelerator for producing a neutron beam, as well as a moderator-reflector system having at least one moderator for producing a moderated neutron beam, and a reflector surrounding the moderator and the second target, in which reflector there is an opening facing the at least one moderator, and at least one moderated neutron beam exiting channel is arranged in the vicinity of the at least one opening.

The object of the invention also relates to a method for the production of a neutron beam using such a neutron source.

Neutron beams have gained wide application in various fields of science, technology and healthcare. In the past it was mainly applications in connection with research and nuclear technologies that were in the foreground, and neutron source were and are being constructed for these applications at great expense. The costs to construct these may reach as much as HUF 800 billions, and their annual operation overheads up to HUF 60 to 70 billion. The high construction and operation cost of such equipment represents a serious obstacle to their use for industrial and healthcare purposes. In the past 10 years accelerator-based neutron sources have started to appear that have construction and operation costs that are 100 to 500 times lower. Although these sources are only able to produce neutron beams that have an intensity approximately 100,000 times lower than the most expensive, top devices, for many applications (mainly materials testing, classification, the development of industrial processes, radiation therapy) they emit sufficient beam intensities at a much lower cost and expense.

The main attributes of the neutron beams produced by neutron sources are the energy of the neutrons and the precision with which the energy can be set, i.e. the energy distribution spectrum of the neutrons, the degree of its monochromacity. From the aspect of the type of application the primary parameter is the average energy of the neutron beam. This may be the cold neutron energy range (approx. 0-0.025 eV energy), the thermal neutron energy range (approx. 0.025-0.3 eV), the epithermal energy range (approx. 0.3-300 eV), the slow neutron energy range (approx. 300 eV-500 keV), the fast neutron energy range (approx. 500 keV-20 MeV) and the high-energy range (>20 MeV). From the point of view of practical, primarily industrial applications neutron beams in the cold, thermal, slow and fast ranges are the most important, but high-energy neutrons may also be needed. The main area of application of cold and thermal neutrons are atomic-level materials testing and materials diagnostics using neutron scattering, and the non-destructive testing of the macroscopic internal structure of structures (especially in the transport industry) and other artefacts (especially in the field of archaeology) using neutron radiography and tomography. Radiation therapy with slow neutrons is a quickly developing field in cancer treatment especially in Japan, and trans-illumination with fast neutrons is an increasingly important quality testing method in the construction industry. The determination of the monochromacity, the energy of neutron beams in neutron research testing performed at the atomic-molecular scale, in other words in the range of cold and thermal neutrons is of fundamental importance so that the speed of the neutrons for this can be set and/or observed with a precision of 0.1 to 10% to optimise the sensitivity and resolution of the tests. In the case of accelerator-based neutron sources the neutrons are produced for these tests in impulses, and to create the above observation precision range the observation of the time of flight of the neutrons must be possible between precision limit values most frequently between from 20 μs to 2 ms.

The proton accelerator in proton accelerator-based neutron sources known from the state of the art operate with a specific (proton) energy, which corresponds to the various applications to various extents. For example, in the case of a Li target and proton energy of 2.5 MeV the majority of the directly created neutron spectrum remains under 1 MeV. This is optimal for BNCT cancer therapy (Boron Neutron Capture Therapy), for example. However, these neutrons are unsuitable for testing large concrete/reinforced concrete objects and structures (such as concrete girders on bridges), where the higher energy neutrons have much greater penetrability for the transillumination. Neutrons reaching an energy level of, for example, 5 MeV are much more preferable for this.

The objective of the invention is to provide a device and method that is free of the disadvantages of the solutions according to the state of the art. The objective of the invention is especially to provide a solution with which various proton-energy-level proton beams, and so neutron beams optimal for various applications can be produced one after the other, or in timesharing or impulse-sharing operation mode using only one device.

The objectives set for the invention are achieved with the neutron source according to claim 1 and with the method according to claim 19.

The neutron source and method according to the invention are suitable for multiple uses both within the scope of low-output neutron sources, and intermediate-output neutron sources suitable for performing research tasks.

In the case of the neutron sources according to the state of the art, an additional problem is the determination of the energy distribution spectrum of the neutrons, which is usually used for the determination of time of flight. This is facilitated by the neutron source operating in impulse mode, which is a considerably widespread feature of such sources. This mainly has great significance in materials research performed with cold and thermal neutrons.

In the case of proton accelerator-based neutron sources, the method for the determination of the time of flight for neutron beams produced in impulse mode and so consisting of impulses is applied so that, for example, the time is measured when neutrons traveling in an impulse packet are detected using a detector arranged at a given distance from the neutron source, and in this way from the measured time of flight and the known distance the speed distribution of the neutrons, and so its corresponding energy distribution spectrum is determined. The method for determining time of flight becomes more precise as the examined neutron beam impulse or the proton beam impulse producing it becomes shorter. Neutron impulses of between approximately 10 to 30 μs are typically used for high-resolution speed measurement. However, this impulse length has a disadvantageous effect on the neutron beam intensity, and it is especially in the case of small-angle neutron distributions that a significant loss of intensity occurs as a result of the use of short impulses, as here it is typically impulses of a length of 1 to 3 ms that provide the best performance.

According to a further aspect of the invention, it is aimed at providing a solution that makes high-resolution speed measurement possible even in the case of longer impulses.

The set task is solved in the case of the solution according to the invention by using a statistical neutron chopper that penetrates into the cold and/or thermal and/or epithermal neutron beam exiting channel, which has a rotating disc on which there are radial slits forming a pseudo-random pattern that chop up the neutron beam.

In the configuration according to the invention a neutron beam passing through the neutron chopper has a special time structure that makes it possible to perform high-resolution speed measurements and also achieve high beam intensity at the same time by it permitting the use of high-intensity long impulses, which the neutron chopper makes suitable for high-resolution speed measurement through complex random modulation made up from short impulses (approx. 15 to 30 μs in practice). Nevertheless, with averaging over the random modulation their influence disappears (averaged out to zero) in speed measurement performed on the time scale determined by the long impulses, while as a result of the random modulation the loss of intensity is only 50%. In comparison, if short impulses were to be produced in order to obtained good speed resolution, for example as compared to impulses 1 msec in length only 1 to 3% of the intensity would remain.

In other words, the time structure of the neutron source according to the invention makes it possible to read both high and low resolution data from a single measurement with close to ideal parameters in conventional speed determination via neutron time of flight. In this way, on the one part, a significant gain in information and measurement time saving is achieved by the situation that several measurements do not have to be made with various impulse lengths. On the other part, the same time structure may be used in a given beam in several measurements, irrespective of the time resolution demands of the individual measurements. The basic long impulse structure is supplied by the impulses of the proton accelerator similarly for each beam, while the neutron beam chopper copying onto it a random modulation is able to create several neutron beams at the same time for the fast time resolution capability. To date there have been examples of the random modulation of neutron beams as a function of time, but there has been no example of the random superimposition of fast and slow time structures in neutron sources.

The neutron source according to the invention can also be operated in continuous mode, which is optimal in irradiation and transillumination applications. This especially relates to exclusively irradiation applications, to neutron beam(s) produced by the first proton target with an energy of <1 MeV.

According to an especially preferred embodiment the solution relates to a compact proton accelerator-based neutron source that is able to simultaneously provide the selection of the optimal energy of neutron beams and the observation of the speed distribution in a wide range of various applications. Namely, it simultaneously emits cold, thermal, epithermal, slow and fast neutron beams, and among these the cold, thermal and epithermal beams up to 10 eV are supplied with impulse modulation which has effective monochromicity, and high-resolution observation of speed ensured as described above.

Further preferred embodiments of the invention are determined in the dependent claims.

Further details of the invention will be explained by way of exemplary embodiments with reference to figures, wherein:

FIG. 1 shows a black diagram of a preferred embodiment of a neutron source 100 according to the invention.

Figure 1:
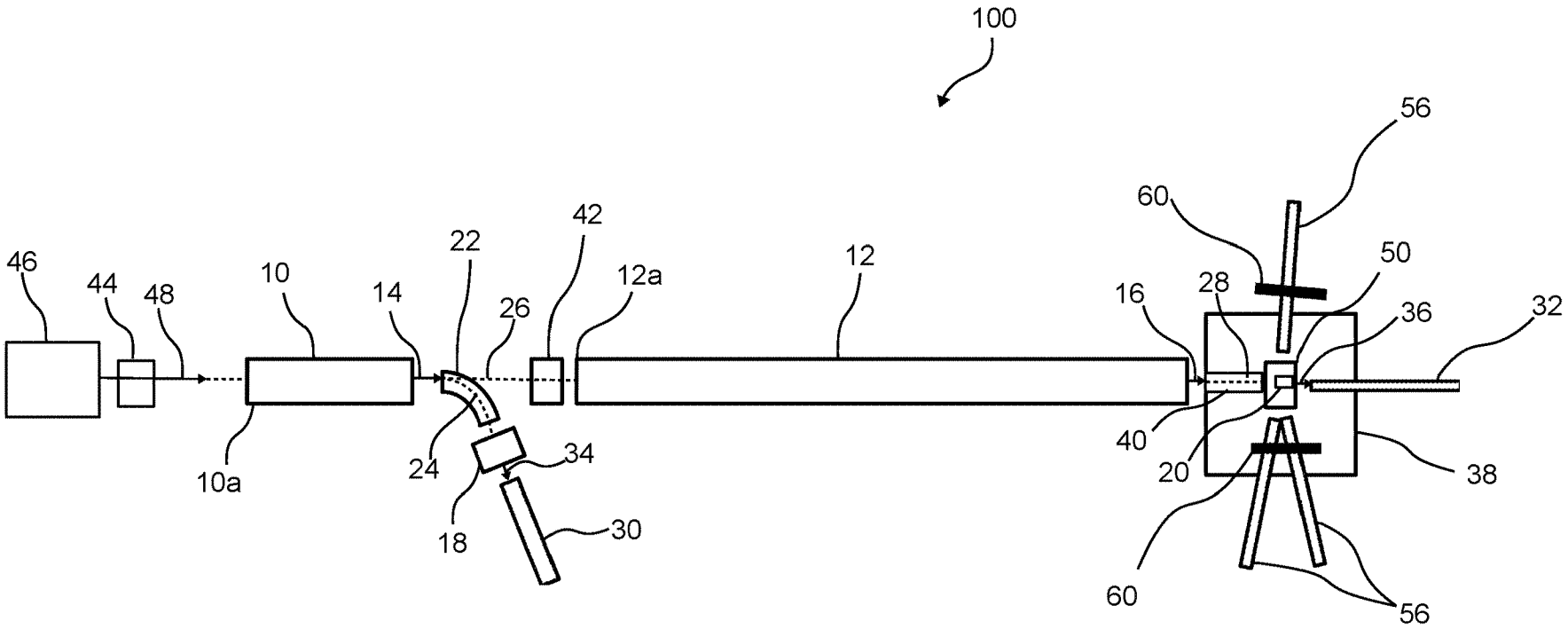
FIG. 1 depicts a schematic block diagram of an exemplary neutron source according to the invention.

The neutron source 100 contains a first proton accelerator 10 and a second proton accelerator 12. The first proton accelerator 10 serves for producing the first proton beam 14 having a first energy, while the second proton accelerator 12 serves for producing the second proton beam 16 having a second energy by further accelerating the first proton beam 14.

The first energy of the first proton beam 14 is preferably between 1-4 MeV, preferably between 1-3 MeV, even more preferably between 1.5-3 MeV, and most preferably between 2-3 MeV.

The second energy of the second proton beam 16 is preferably between 5-50 MeV, but the second proton beam 16 may even be accelerated to a higher energy, to as much as more than even 1000 MeV in the proton accelerator 12. In the case of an especially preferred embodiment, the energy of the second proton beam is between 5-13 MeV.

The proton accelerators 10 and 12 may be any known type of proton accelerator corresponding to the desired energy range.

The neutron source 100 also contains a first target 18 and a second target 20, as well as a proton beam deflector 22 arranged between the first proton accelerator 10 and the second proton accelerator 12, which serves for deflecting the first proton beam 14 arriving from the first proton accelerator 10.

The deflector 22 is formed in such a way that it directs the proton beam 14 to the first target 18 in a first operation state, and to the second proton accelerator 12 in a second operation state. Any known type of deflector or deflector system can be used as the proton beam deflector 22 that is able to deflect protons of the desired energy, as is well known by a person skilled in the art. Such deflectors 22 typically operate on a magnetic principle: with an electromagnet switched on the positive charges flying in the typically magnetic dipole field 1 T are deflected due to the effect of the Lorenz force occurring, and as a result they exit the deflector 22 in a direction different to the original flight direction.

Preferably the first operation state is the switched off state of the deflector 22, in such a case the proton beam 14 continues without deflection, while the second operation state is the switched on state of the deflector 22, in which it deflects the proton beam 14 passing through it. Naturally embodiments may be conceived in the case of which the proton beam 14 is deflected in the second operation state, but at various angles according to various options, so the proton beam 14 exits the deflector 22 in several directions, and in timesharing mode several targets can be used with the first proton energy. Naturally, embodiments are conceivable in the case of which the proton beam 14 is deflected in the first operation state also, but at a different angle compared to the second operation state.

In the case of the preferred embodiment presented in FIG. 1 with the deflector 22 in switched on state the first proton beam 14 progresses along the first beam trajectory 24 following the dotted curved line, and reaches the first target 18. With the deflector 22 in switched off state the proton beam 14 reaches the second proton accelerator 12 without changing direction, along the second beam trajectory 26 marked with a dotted straight line. In other words, the deflector 22 is arranged in the common section of the first beam trajectory 24 and the second beam trajectory 26, and corresponding to the switched on or off state it deflects the proton beam 14 arriving there to the first beam trajectory 24 or permits it to continue along the second bean trajectory 26. Naturally, a reverse arrangement may also be established, in the case of which the beam trajectory 26 leading to the second proton accelerator 12 is deflected, and the first beam trajectory 24 is a straight line trajectory corresponding to the switched off operation state. As mentioned above, even both beam trajectories 24, 26 may be deflected, and the desired angle of deflection is achieved by controlling the magnitude and extent of the current flowing in the electromagnet of the deflector 22. Obviously, more than two beam trajectories can be established, such as in the interest of the proton beam 14 being directed to further targets.

In the case of the embodiment shown the second proton beam 16 reaches the second target 20 along the third beam trajectory 28 from the second proton accelerator 12 without being deflected, however, naturally further proton beam deflectors may also be arranged after the second proton accelerator 12, with which, for example, the second proton beam 16 may be guided to further targets, or to further proton accelerators if more than two proton energy levels are to be provided for the purpose of producing neutrons in various energy ranges.

It may be preferable to use more than two proton energies in the neutron source 100, for example, to avoid high-energy neutrons, which are the most difficult to handle from the point of view of radiation protection, in some of the applications. In this case the proton beam 16 exiting the second proton accelerator 12, in the same way as described for that exiting the first proton accelerator 10, is deflected using a second deflector either to the second target 20 or to a third accelerator as required to further increase the proton energy in the interest of use for a third target. This case, and making even more proton energy available in a similar way, are not shown in the figures illustrating the principle.

From the point of view of avoiding high-energy neutrons the second energy of the second proton beam 16 may be preferably between 5 and 13 MeV and the energy of the protons exiting the third accelerator is preferably over 20 MeV.

The energy spectrum of the neutrons directly produced by the nuclear reactions created in the first and second targets 18, 20 (and in all other possible targets) by the proton beams 14, 16 is primarily determined by the energy of the proton beams 14, 16, but the material of the target also plays a role in this. The material of the targets 18, 20 is selected in accordance with the neutron energy to be produced with the given proton beam 14, 16, in other words so that the given energy proton beam 14, 16 is suitable for creating the desired neutron energy in the course of their collision with the nuclei of the atoms of the target 18, 20, as is obvious for a person skilled in the art. For example, for the first proton beam 14 with given energy between 2-3 MeV a lithium target 18 is preferably used, in this way optimally mostly neutrons in the slow neutron energy range (approx. 300 eV-500 keV) are generated.

Preferably a lithium or beryllium target 20 may be used for the second proton beam 16 preferably with given energy between 5-13 MeV, in this way mostly neutrons in the fast neutron energy range (approx. 500 keV-13 MeV) are preferably created when the incoming protons collide with the nuclei of the atoms of the target 20.

If a third proton beam is also produced, which is deflected to a third target, then the energy of the third proton beam is preferably at least 20 MeV, which is also preferably deflected to a lithium or beryllium target, and in this way a neutron beam containing neutrons in the high neutron energy range (>20 MeV) is also produced. Naturally a second proton beam 16 with an energy of 20 MeV or above may also be produced with the second proton accelerator 12, in this case neutrons in the high neutron energy range can also be generated with this.

Applications exist when higher energy protons are a problem and harmful (e.g. healthcare). In such a case it is preferable to use the first proton accelerator 10 producing a proton beam 14 in the slow neutron energy range and the associated first target 18. The second proton accelerator 12 producing the fast neutron energy proton beam 16 is preferable because the most moderated cold and thermal neutrons can be produced with it. However, in this case it is practically preferable if high-energy neutrons (>20 MeV) are not produced because radiation protection is more difficult against them (although this is not critically disturbing, but it is costly and requires a lot of space). However, there are applications in which high-energy neutrons are also required, e.g. in the case of simulating cosmic radiations, which is important for the testing of aircraft electronics.

One or more first neutron beam channels 30 are formed on the side of the first target 18 opposite the incoming proton beam 14 (one is shown in the figure), to guide the first neutron beam 34 created in the first target 18. The one or more neutron beam channels 30 may also be theoretically formed on another side (sides) of the target 18, but in the case of most applications it is preferable to select the side opposite the proton beam 14, because it is in this direction that the most neutrons directly originating from proton collisions exit the target 18, therefore the intensity of the neutron beam 34 will be the greatest in this direction. Even more preferably the one or more neutron beam channels 30 are formed substantially close to the continuation of the first beam trajectory 24.

Similarly, one or more second neutron beam channels 32 are formed on the side of the second target 20 opposite the incoming second proton beam 16 (one is shown in the figure), to guide the second neutron beam 36 created in the second target 20. Even more preferably, here also the one or more neutron beam channels 32 are formed substantially close to the continuation of the second beam trajectory 28 of the second proton beam 16.

The neutron beam channel 34, 36 may be any known channel that guides neutrons, and that may be coated on the inside with a material that reflects neutrons.

The second target 20 is preferably surrounded by radiation shielding 38, which may be constructed from, for example, steel, reinforced concrete, concrete, or from a combination of these, as is known by a person skilled in the art. Naturally, radiation shielding may also be installed, or needed around the first target 18 in accordance with the actual use.

The second proton beam 16 penetrates the radiation shielding 38 via the proton beam channel 40, in other words the third beam trajectory 28 is located in this proton beam channel 40. The other proton beam trajectories 24, 26 are preferably also running in proton beam channels (not indicated), and these and the proton beam channel 40 comprise a common vacuum space up until the end of the proton beam channel 40.

Other proton beam deflecting elements (various types of magnet) may also be located in the neutron source 100. For example, preferably a Medium Energy Beam Transport 42 is arranged on the second beam trajectory 26 on the beam entry side 12*a* of the second proton accelerator 12, which ensures the appropriate focus and guiding of the proton beam 14 into the second proton accelerator 12, as is well known to a person skilled in the art.

Similarly, preferably a Low Energy Beam Transport 44 may be provided on the beam entry side 10*a* of the first proton accelerator 10, which serves to guide a proton beam 48 into the proton accelerator 10, which proton beam 48 arriving from a proton source 46 which can be external or forming a part of the neutron source 100. The proton source 46 and the Low Energy Beam Transport 44 may also be provided as a single unit, as is well known to a person skilled in the art. It is preferable to create the proton beam 48 in the form of pulses for the applications to be detailed later on, which may be implemented with a proton beam interrupter integrated into the proton source 46 and/or into the Low Energy Beam Transport 44 in a known way.

As a result of the two-level proton acceleration and the proton beam deflection possibility provided between the two, a single neutron source 100 is suitable for various applications, neutron beams 32, 34 of various energy levels can be produced, which the conventional neutron sources are not capable of. For example, a neutron beam 34 in the slow neutron energy range (for cancer treatment, for example) and a neutron beam 36 in the fast neutron energy range (for transilluminating an artefact for performing a materials test, for example) can be produced alternately. This may be performed, for example, by switching the proton beam deflector 22 from the one operation state to the other operation state at specific intervals, in this way the proton beam 14 is guided to the first target 18, which by colliding with its atom nuclei creates mainly neutrons in the slow neutron energy range, or the proton beam 14 is guided to the second proton accelerator 12, from where it reaches the second target 20 to create neutrons mainly in the fast neutron energy range. This is called timesharing operation mode. If the proton beam 14 (and so the proton beam 16 also) is produced in impulses, and as a result of the change at specific intervals of the deflector 22 the sequential proton beam 14 impulses get to the first target 18 and the second proton accelerator 12 alternately, then this is called impulse sharing operation mode.

Conventional deflector magnets are able to switch a proton beam with an energy level of 2-4 MeV from the original direction to another selected, significantly different direction in 1-3 seconds. For the duration of the temporary state of the switch-over it is preferable to switch off the proton source. By using an electrostatic chopper a deflector 22 can be created that switches much faster than this, which, as is well known by a person skilled in the art, the direction of the beam can be changed in a fraction of 1 ms in the framework of impulse sharing operation mode.

Figure 2:
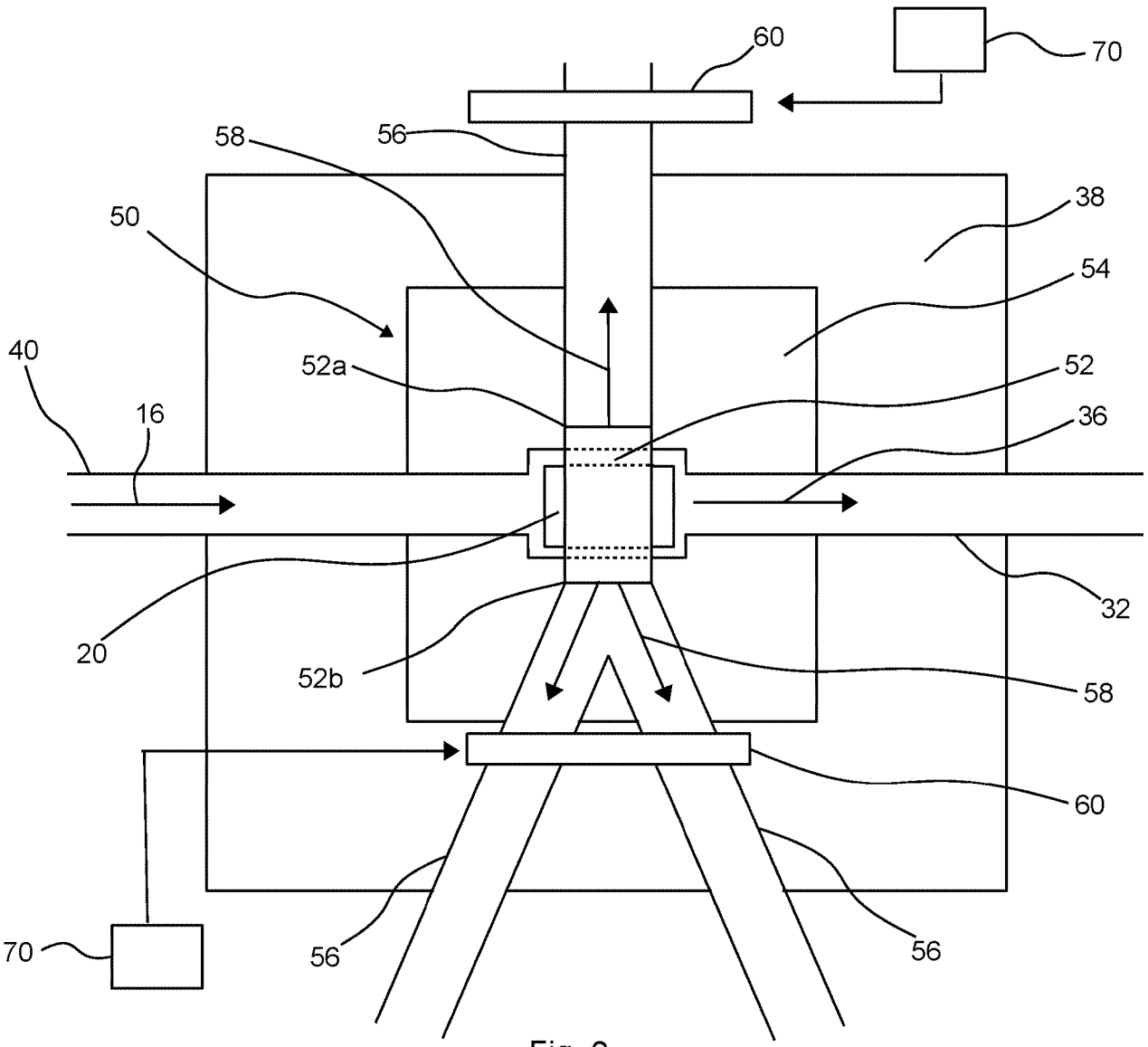
FIG. 2 depicts a schematic block diagram of the moderator-reflector system according to FIG. 1.

In the case of the especially preferred embodiment shown in FIG. 1 neutron beams in other energy ranges, apart from the first and second neutron beams 34, 36 with slow and fast energy ranges, can be produced using the moderator-reflector system 50 surrounding the second target 20, which is also illustrated in more detail in FIG. 2.

The moderator-reflector system 50 has at least one moderator 52, and a reflector 54 surrounding the moderator 52 and the second target 20. The moderator 52 is typically a medium containing H (hydrogen) molecules (such as a vessel filled with water, heavy water or liquid hydrogen, a graphite block, etc.), in which the neutrons moving in directions deviating from the neutron beam channel 32, and those reflected by the reflector slow down on colliding with H or other light atoms, in this way obtaining neutrons in the cold and/or thermal and/or epithermal neutron energy ranges.

It should be noted here that if higher proton energy is used, fast neutrons will dominate, and there will be a greater number of neutrons produced. Therefore, it is preferable to place the one or more moderators 52 (that produce much lower energy cold, thermal and epithermal neutrons from both the slow and fast neutrons) next to the second target 20, but naturally in the place of or in addition to this a similar moderator-reflector system 50 may also be provided around the first target 18.

In the case of the arrangement according to FIG. 2 the moderator 52 is located above the second target 20, which is indicated with the concealed perimeter of the second target 20 shown with a dotted line. In the case of this embodiment the moderator 52 is elongated in shape, and the moderated neutron beams 58 containing the slowed down neutrons are guided out through the neutron beam lines 56 facing its two ends 52*a*, 52*b*, in the case of the present embodiment one neutron beam line 56 is formed at the end 52*a* of the moderator 52, and two neutron beam lines 56 may be found at the other end 52*b*. Naturally, several neutron beam lines 56 may be provided at any end 52*a*, 52*b*, and one or more neutron beam lines 56 may also be arranged at other parts of the moderator 52, as is known by a person skilled in the art.

Similarly, further moderators 52, and the associated neutron beam lines 56 may also be arranged around the target 20, in the interest of, for example, producing moderated neutron beams 58 of various temperature (in other words in various energy ranges), in which neutrons of various temperatures dominate. For example, a neutron beam (or beams) 58 containing a majority of thermal neutrons moderated with the first moderator 52 is produced, while a neutron beam (or beams) 58 containing a majority of cold neutrons moderated by the second moderator 52 is produced, therefore, in this way several applications can be supplied (such as a materials test or structural test) with a single neutron source 100.

From the point of view of the intensity of the moderated neutron beam it is preferable to arrange the moderator-reflector system 50 around the second target 20 irradiated with greater proton beam energy. Nevertheless, it is also possible to provide a moderator and a moderator-reflector system around the first target 18. In the above a configuration has been presented as an example and in order to present the principles where the moderator 52 is next to the second target 20, and there are no more than two targets 18, 20, however, on the basis of the description it is obvious for a person skilled in the art that several targets may also be used, and moderator-reflector systems 50 can also be provided around other targets.

Another aspect of the invention is presented in the following, with the help of which a single neutron source 100 can be used to emit a neutron beam 36 in the fast neutron energy range, and moderated neutron beams 58 in the cold and/or thermal and/or epithermal energy ranges, and among these the cold, thermal and epithermal (up to 10 eV) neutron beams 58 are provided with impulse modulation, the effective monochromicity, and the high-precision observation of speed of which are ensured, while the beam intensity does not substantially decrease. This aspect of the invention may be combined with two-stage proton acceleration, and with the possibility for proton beam deflection between the two, through this a further neutron beam 34 in the slow neutron energy range can also be produced within the same neutron source 100, in addition, even in quasi-simultaneous time sharing or impulse sharing operation mode. Therefore, in the case of an especially preferred embodiment the second aspect of the invention is combined with the neutron source 100 presented above, therefore, for the sake of simplicity, this combination has been depicted in FIGS. 1 and 2.

Figure 3:
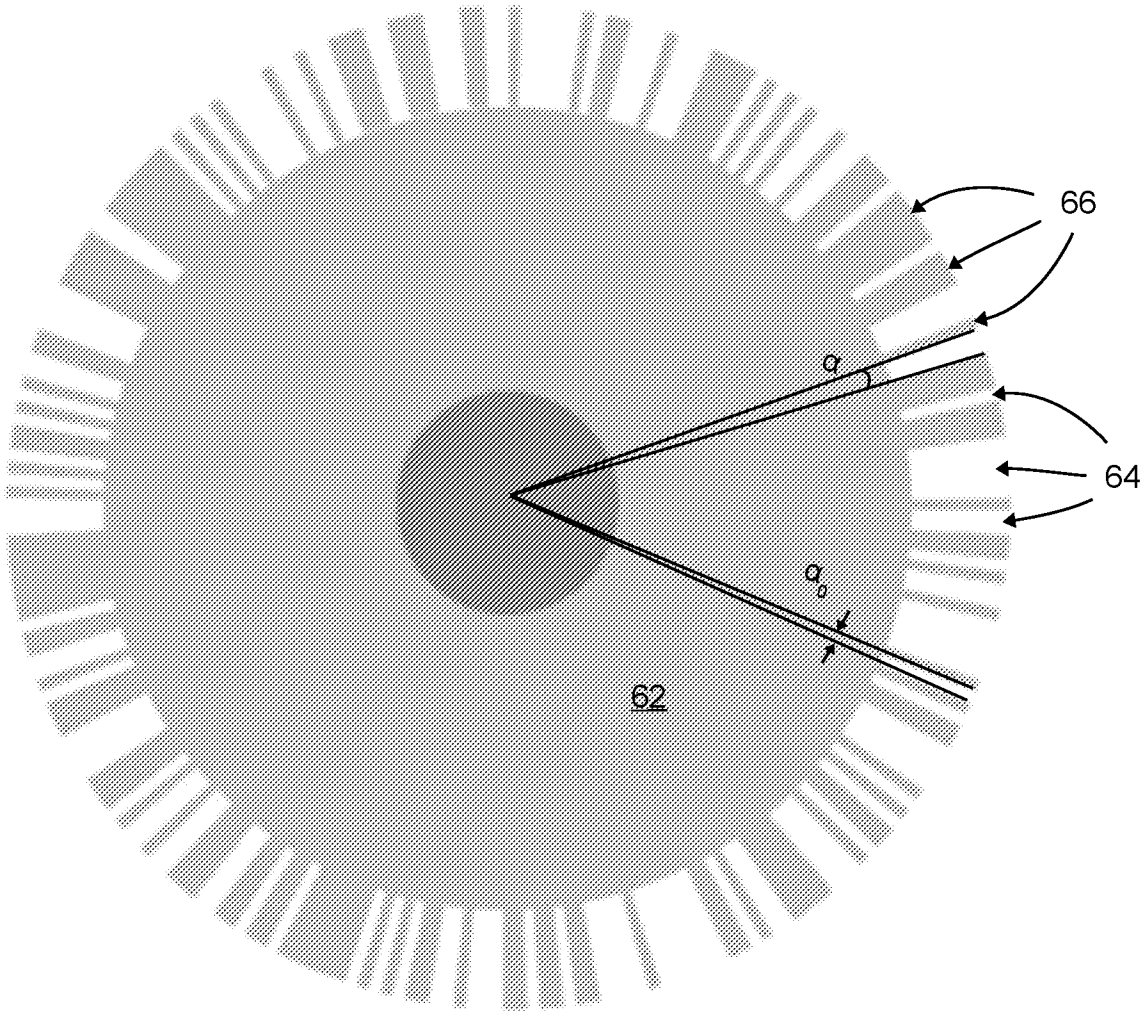
FIG. 3 depicts a schematic view of an exemplary neutron chopper disc.

According to the second aspect of the invention the neutron source 100 comprises at least one neutron chopper 60 extending into the neutron beam lines 56 guiding the moderated neutron beams 58. The neutron chopper 60 has a rotating disc 62 (see FIG. 3) that contains the radial slits 64 forming the pseudo-random pattern that chops the moderated neutron beam 58. A suitable pseudo-random pattern may be found in the publication by F. Mezei et al. entitled "Enhanced Performance Neutron Scattering Spectroscopy by Use of Correlation Techniques" and located on the website: https://arxiv.org/ftp/arxiv/papers/1609/1609.03287.pdf, the content of which is built in here in its entirety as a reference. The solid material between the slits 64 of the disc 62 form radial blocking areas 66, in which the moderated neutron beam 58 is absorbed when they get into the path of the neutron beam 58 while rotating. As opposed to this, the neutron beam 58 passes through the slits 64 without obstruction. In summary then, the rotating disc 62 of the neutron chopper 60 located in the path of the neutron beam 58 chops the neutron beam 58 in accordance with the pseudo-random pattern of the radial slits 64 and blocking areas 66.

For example, the pseudo-random pattern of the radial slits 64 and blocking areas 66 is created by dividing the disc 62 into equal angle ranges, then the numerals 0 and 1 are pseudo-randomly allocated to each angle range. Mathematically several such special pseudo-random series are known, an example of these is the series consisting of 255 elements presented in Table 1, of which elements 127 are 0 and 128 elements are 1. In every row of Table 1 the first serial number of the 20 sequential elements of the number series has been indicated, in other words in the first row, for example, elements 1 to 20 of the series can be seen in order.

TABLE 1

| | | | | | | | | | | | | | | | | | | | | |
|---|---|---|---|---|---|---|---|---|---|---|---|---|---|---|---|---|---|---|---|---|
| 1 | 1 | 1 | 1 | 0 | 0 | 1 | 1 | 1 | 0 | 0 | 0 | 1 | 1 | 0 | 0 | 1 | 0 | 0 | 0 | 0 |
| 21 | 0 | 1 | 0 | 1 | 1 | 0 | 0 | 0 | 1 | 0 | 0 | 0 | 1 | 1 | 1 | 1 | 0 | 1 | 0 | 1 |
| 41 | 0 | 1 | 0 | 0 | 1 | 0 | 0 | 1 | 1 | 1 | 0 | 1 | 1 | 1 | 1 | 1 | 0 | 1 | 1 | 1 |
| 61 | 0 | 0 | 0 | 1 | 0 | 0 | 1 | 1 | 1 | 0 | 1 | 1 | 1 | 0 | 0 | 0 | 0 | 0 | 1 | 0 |
| 81 | 0 | 1 | 1 | 0 | 1 | 0 | 0 | 1 | 0 | 0 | 0 | 0 | 0 | 1 | 0 | 1 | 0 | 1 | 1 | 0 |
| 101 | 0 | 0 | 0 | 1 | 0 | 1 | 0 | 1 | 1 | 0 | 1 | 0 | 0 | 0 | 1 | 1 | 1 | 1 | 0 | 0 |
| 121 | 1 | 0 | 1 | 1 | 0 | 0 | 0 | 0 | 0 | 0 | 1 | 0 | 0 | 0 | 0 | 1 | 1 | 0 | 1 | 1 |
| 141 | 0 | 1 | 1 | 0 | 0 | 0 | 1 | 0 | 0 | 1 | 1 | 0 | 1 | 0 | 1 | 0 | 1 | 1 | 1 | 1 |
| 161 | 1 | 1 | 0 | 1 | 1 | 0 | 1 | 1 | 0 | 0 | 1 | 1 | 1 | 0 | 0 | 1 | 0 | 0 | 1 | 0 |
| 181 | 1 | 1 | 1 | 0 | 0 | 0 | 0 | 1 | 1 | 1 | 0 | 1 | 0 | 0 | 1 | 1 | 0 | 1 | 1 | 1 |
| 201 | 1 | 1 | 1 | 1 | 0 | 0 | 0 | 1 | 0 | 1 | 0 | 1 | 1 | 0 | 1 | 0 | 1 | 0 | 0 | 1 |

TABLE 1-continued

| | | | | | | | | | | | | | | | | | | | | |
|---|---|---|---|---|---|---|---|---|---|---|---|---|---|---|---|---|---|---|---|---|
| 221 | 1 | 0 | 0 | 0 | 0 | 1 | 1 | 1 | 1 | 1 | 0 | 0 | 1 | 1 | 1 | 1 | 1 | 1 | 1 | 0 |
| 241 | 1 | 0 | 1 | 0 | 1 | 0 | 0 | 0 | 0 | 1 | 0 | 0 | 1 | 0 | 0 | | | | | |

Subsequently, in the angle ranges allocated the numeral 1 the material of the disc 62 is cleaved along a circular ring thereby creating the slits, while in the angle ranges allocated the numeral 0, the disc 62 is left untouched, therefore there the material of the disc 62 forms blocking areas 66. In this way the angles $\alpha$ between the radial sides of the slits 64 are the pseudo-random whole number multiples of a given angle. The number n may be selected in various ways, in the case of the pseudo-random numeral generating algorithm described in the publication referred to above n=127 or 255 or 511, preferably, however, n=255. The pattern is random in the sense that by rotating the disc 62 by a whole number multiple of the angle $\alpha_0$, the correlation of the rotated pattern and the original pattern is exactly 0, in other words they do not correlate. There is one exception to this: if the angle of rotation is one or more complete rotations, the pattern repeats itself. This is what the pseudo-random designation refers to: a strictly random pattern is infinitely long and does not contain any periodical repetition.

Figure 4:
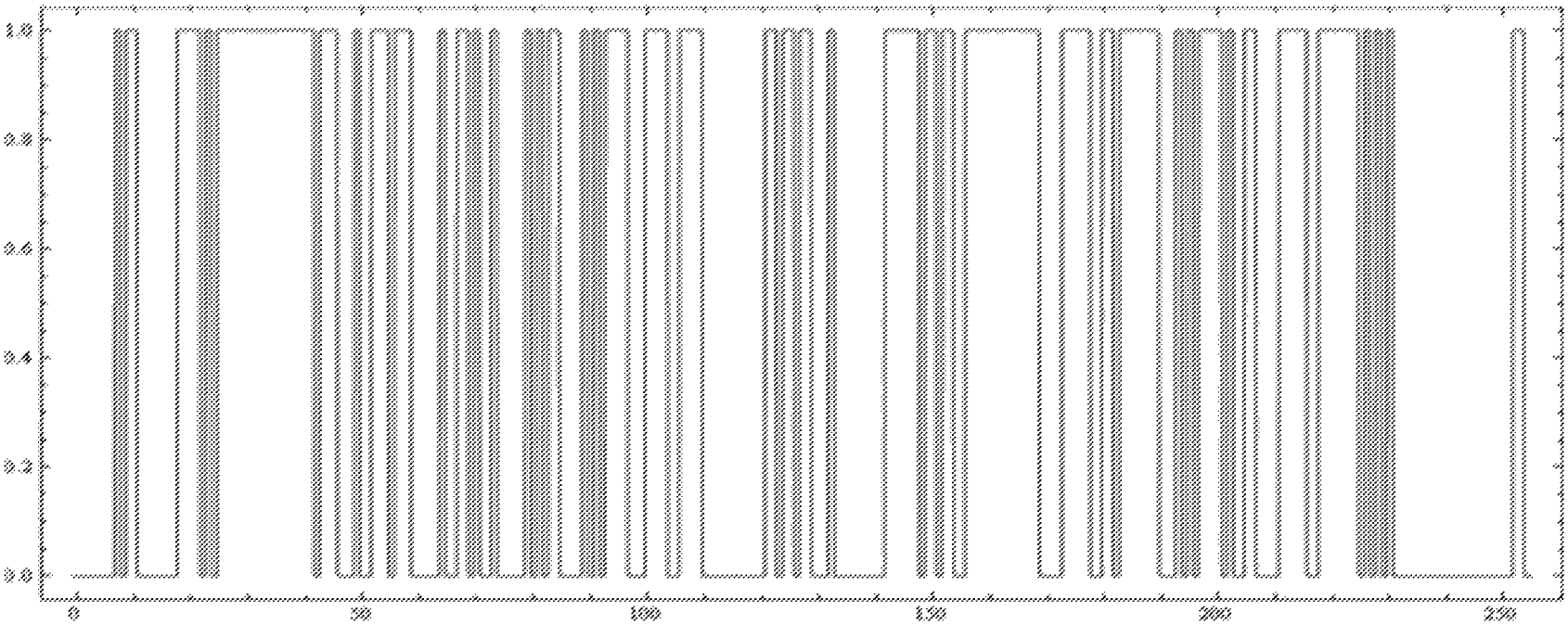
FIG. 4 shows the pseudo-random modulation function realised by the neutron chopper according to FIG. 2.

The rotating slit pattern results in the pseudo-random modulation function shown in FIG. 4, the value of which may taken on the discrete values of 0 and 1 depending on whether at a given moment a blocking area 66 or a slit 64 falls in the path of the neutron beam 58 in the neutron beam line 56, in other words whether the neutron beam 58 is absorbed (function value of 0), or permits it to pass through (function value of 1). The time scale depends on the speed of rotation of the disc 62. In the case of the function according to FIG. 4 the function values have been indicated in discrete time units corresponding to the unit of rotation (360/255 degrees) of slit 64 or blocking area 66.

The statistical neutron chopper 60 is provided with a control system 70 that sets the angular speed of the disc 62 so that slit 64 corresponding to the unit of angle $\alpha_0$ permits the moderated neutron beam 58 to pass through the neutron beam line 56 into which the disc 62 protrudes for typically between 10 and 50 μs while the disc 62 is rotating. If the transmitted width of the neutron beam is the same or smaller that the unit of slit 64 (with angle $\alpha_0$), then the time resolution of the statistical neutron chopper 60 corresponds to the duration of rotation of the angle $\alpha_0$. If it is wider than this the time corresponding to the time resolution will be longer in proportion with the width of the beam, and the intensity of the transmitted neutron beam will increase by this same proportion.

In the case of a preferred embodiment the speed of rotation of the disc 62 is 18000 rpm, in such a case the period of rotation of the unit of angle $\alpha_0$ will be 13.07 μsec in the case of a disc consisting of 255 units, in other words the moderated neutron beam 58 is either blocked or permitted to be transmitted at each point of the neutron beam line 56 for a time corresponding to a whole number multiple of 13.07 μsec depending on whether a blocking area 66 or a slit 64 passes through the neutron beam line 56 in the path of the neutron beam 58.

The neutron beam 58 passing through the statistical neutron chopper 60 gains a special time structure that makes it possible to achieve both high-resolution speed measurement and high beam intensity at the same time by making it possible to use high intensity long impulses (for example, impulses in the order of msec, such as impulses lasting 1-3 msec), which the neutron chopper 60 transforms into short impulses suitable for high resolution speed measurement with fast, pseudo-random modulation (approx. 15-50 μsec in practice). For example, a proton beam 16 produced in 1.5 msec impulses at half-height results in a moderated neutron beam 58 consisting of impulses 1.5 msec wide, which are of preferable high intensity from the point of view of practical application. After passing through the statistical neutron chopper 60 according to the invention the intensity of the moderated neutron beam 58 is only halved (as the proportion of slits 64 and blocking areas 66 is more or less 1:1), meanwhile the speed spectrum of the short impulses produced through the modulation can now be determined with high resolution. In comparison, if the short impulses were to be produced using conventional (not statistical) neutron stoppers for good speed resolution, as compared to 1 msec long impulses only 1-3% of the intensity would remain.

A further advantage of the neutron source 100 according to the invention is that if the second proton accelerator 12 produces a second proton beam 16 between approximately 5-50 MeV, then in this case the statistic neutron chopper 60 may also be arranged within the radiation shielding 38 surrounding the moderator-reflector system 50, as illustrated in the case of the neutron chopper 60 illustrated at the bottom of FIG. 2. In the case of the use of higher energies, naturally in the interest of the radiation protection of the neutron chopper 60 it too should be located outside of the radiation shielding 38, as it may be observed in the case of the neutron chopper 60 illustrated in the upper part of the figure.

The advantage of arrangement within the radiation shielding 38 is that in this way a single neutron chopper 60 may protrude into several neutron beam lines 56 deflecting moderated neutron beams 58, as within the radiation shielding 38 these neutron beam lines 56 still run sufficiently close to one another.

Accordingly, in the case of the preferred embodiment shown in FIGS. 1 and 2 the one statistical neutron chopper 60 protrudes into two neutron beam lines 56 deflecting moderated neutron beams 58, which is possible because the statistic neutron chopper 60 used in the case of the neutron source 100 according to the invention results in a universal time structure: the neutron beam 58 passing through at the same time gains a fast time structure (the fast modulation results in locally short unit impulses), while in the meantime it also retains its original slow time structure of the accelerator operating with impulses 1-3 msec in length (with averaging over the random modulation the fast time structure is averaged out, and the slow time structure corresponding to the impulses of the proton beam 16 is portrayed). Therefore, it is of no importance what use the moderated neutron beams 58 passing through the common statistical neutron chopper 60 are to be put to, as the time structure obtained carries the short or long time structure information, or a time structure between the two, required for all applications at the same time.

This random superimposition of the fast and slow time structures has not yet existed in conventional neutron sources. As a result of the pseudo-random nature of the mechanical rotating disc neutron chopper 60 presented as an example, the practically random superimposition requires that the frequency of the proton impulses and the frequency of the rotation around the statistical neutron chopper 60 do not have common harmonics within the degree of precision of the regulation of frequency, and that the length of the moderated neutron impulses be shorter than the time of one complete rotation of the disc 62 of the statistical neutron chopper 60. Random patterns, in other words patterns not repeating themselves over a practically infinite length may be produced electronically, but the modulation depth and beam intensity of neutron beam choppers operating with electronically produced impulses today are significantly lower than those of rotating disc mechanical choppers.

An example of a chopper operating with electronically produced impulses is the neutron polarisation-based neutron polarisation chopper, in the case of which the intensity of the beam passing through may be modulated over time with the change of neutron polarisation: L. Pal, N. Kroo, P. Pellionisz, F. Szlavik, I. Vizi, "Correlation-Type Time-Of-Flight Spectrometer With Magnetically Chopped Polarized Neutron Beam", Symposium on Neutron Inelastic Scattering, Vol. II (IAEA Vienna 1968) 407-416. Such a neutron polarisation chopper may also be used on the neutron source 100 according to the invention. In this case the neutron polarisation chopper is placed in the path of the moderated neutron beam 58, and by controlling the neutron polarisation chopper a random or pseudo-random polarisation pattern is produced built up from time elements that transmit the neutron beam and that substantially block the neutron beam (e.g. transmitting up to 5%), which chops the moderated neutron beam 58 according to the random or pseudo-random pattern, in other words the neutron transmitting capability of the neutron polarisation chopper varies according to the random or pseudo-random pattern, in addition this takes place in a substantially binary manner (either transmits or does not transmit). In other words when the neutron beam transmitting time element of the pattern is produced using the neutron polarisation chopper then the moderated neutron beam 58 passed through the chopper (this corresponds to the slit 64 of the disc 62), and when the neutron beam substantially blocking time element of the pattern is produced, then the chopper does not permit the moderated neutron beam 58 to pass through (this then substantially behaves like the blocking area 66 of the disc 62). This blocking is typically not perfect due to the lack of perfect polarisation, but naturally the smaller the percentage of the neutron beam that is not permitted to pass in the blocking phase the better the chopper. As a neutron polarisation chopper substantially behaves as a rotating disc neutron chopper 60, it is preferable to select the length of the neutron beam blocking and transmitting time elements (specific duration control elements) in a similar way to the case of the rotating disc neutron chopper 60.

In the case of the moderated neutron beams 58 the neutron source according to the invention is capable of simultaneously ensuring the use of long impulses and high resolution time of flight measurement, in the case of which both are of outstanding importance, and in the case of which to date only the one could be provided. The use of long impulses is very much necessary in order to achieve optimal neutron intensity, as with a given proton current determined by the accelerator system the more protons there are (or neutrons created by protons) in a beam impulse the longer the impulse lasts.

The use of the presented neutron source 100 is as follows.

A first proton beam 14 having a first energy is produced in the first proton accelerator 10. The first proton beam 14 is deflected in first periods with the proton beam deflector 22 to the first target 18, where by the first proton beam 14 colliding with the first target 18 a first energy range (preferably slow neutron) neutron beam 34 is produced. In the second periods between the first periods the first proton beam 14 is guided to the second proton accelerator 12, where a second proton beam 16 is produced with second energy greater than the first energy. The second proton beam 16 is guided to the second target 20, where the second proton beam 16 collides with the second target 20 to create a second energy range (preferably fast neutron) neutron beam 36. From these neutrons it is preferably possible to produce cold and thermal neutrons using moderators. Therefore, the neutron source 100 is able to produce all neutron energy ranges that are important from the point of view of the use of the neutron beams.

In the case of the second aspect of the invention, one or more moderate neutron beams 58 are produced as follows. With the proton source 46 and/or the low energy beam transmitting unit interrupter a proton beam 48 can be produced that consists of impulses with an impulse length of 0.5-5 ms, preferably 1-3 ms. From this the (second) proton beam 16 is produced in the proton accelerator 12, which is guided to the (second) target 20, where the proton beam 16 collides with the target 20 to create the (second) neutron beam 36, which in this way will also consist of impulses. It should be noted that impulses of various lengths and frequencies can be produced for the various targets, and in timesharing mode the targets can be used as desired even during continuous accelerator operation.

Using the moderator 52 one or more moderated neutron beams 58 are produced from the neutrons created in the second target 20, which are chopped in time, such as with the help of the rotating disc 62 statistical neutron chopper 60 with radial slits 64 forming a pseudo-random pattern placed in their path. The moderated neutron beam 58 will typically consist of impulses that are 1-3 ms long. By chopping the moderated neutron beam 58 over time in accordance with a pseudo-random pattern (time modulation), impulse lengths corresponding to the neutron chopper 60 now appear in the modulated neutron beam 58, which are a fraction of both the original proton beam impulses and of the impulses of the modulated neutron beam 58 before modulation, preferably impulses are created with at least 50 times shorter impulse lengths, preferably at least 100 times shorter impulse lengths on average.

Time of flight measurement can be performed on the modulated neutron beam 58 produced in this way, in which the neutrons passing through or scattered by the tested sample are detected in detectors and the time or detection is registered. By comparing the registered time spectrum on the one hand with the spectrum of the duration of the long neutron impulses (typically 1-3 ms in duration) emitted by the moderator 52, which mathematically means the determination of the correlation of the two time spectra, it is possible to measure the distribution (spectrum) of the time of flight of the detected neutrons calculated from the neutron impulses of the source, and with precision equal to the length of the neutron impulses. On the other hand, the calculation of the correlation of this same registered time spectrum with the modulation pattern of the short impulses of the chopper randomly modulating the long neutron impulses means the measurement of the spectrum of the time of flight of the neutrons measured from the statistical chopper, and with precision corresponding to the short unit of time of the statistical chopper.

The invention claimed is:

1. A neutron source comprising
- a proton source configured for producing a proton beam of a first impulse length,
- a proton accelerator for producing an accelerated proton beam,
- a target arranged in the trajectory of the accelerated proton beam exiting the proton accelerator for producing a neutron beam,
- a moderator-reflector system having at least one moderator for producing a moderated neutron beam having a second impulse length,
- a reflector surrounding the moderator and the target, in which reflector an opening is provided facing the at least one moderator, and
- at least one moderated neutron beam exit channel is arranged in the vicinity of the opening, characterised by
- a statistical beam chopper chopping the moderated neutron beam according to a pattern selected from a random and a pseudo-random pattern of time intervals during which the moderated neutron beam is allowed to pass in at least 50 times shorter impulse length than the second impulse length in at least one moderated neutron beam exit channel.

2. The neutron source according to claim 1 wherein the beam chopper is interposed in three moderated neutron beam exit channels.

3. The neutron source according to claim 1, characterised by that the beam chopper comprises at least one statistical neutron chopper extending into the moderated neutron beam, and having a rotatable disc on which there are radial slits forming a pseudo-random pattern for chopping the at least one neutron beam.

4. The neutron source according to claim 3, characterised by that angles between the radial sides of each radial slit are whole number pseudo-random multiples of a given first angle.

5. The neutron source according to claim 3, characterised by that the statistical neutron chopper is provided with a control system that is configured to set the angular rotation speed of the disc so that a slit corresponding to the first angle permits the moderated neutron beam to pass through the moderated neutron beam exit channel into which the disc extends for a time between 15 and 50 μs, preferably for approximately 20 μs while the disc is rotating.

6. The neutron source according to claim 3, characterised by that the at least one statistical neutron chopper protrudes into at least two moderated neutron beam exiting channels.

7. The neutron source according to claim 3, characterised by comprising radiation shielding surrounding the moderator-reflector system, and the at least one statistical neutron chopper is arranged within the radiation shielding.

8. The neutron source according to claim 3, characterised by that the beam chopper is a chopper extending into the neutron beam channel operating with electronically produced impulses, which is configured to produce a random or pseudo-random modulation pattern that chops the at least one neutron beam.

9. The neutron source according to claim 3, characterised by that the moderator-reflector system is multispectral comprising at least two moderators for producing a moderated neutron beam falling in at least two energy ranges selected from cold, thermal and epithermal neutron energy ranges.

10. A method of producing at least one moderated neutron beam, comprising:
- producing a proton beam of a first impulse length in a proton accelerator,
- guiding the proton beam to a target, and producing a neutron beam by colliding the proton beam with the target,
- characterised by:
- arranging a moderator-reflector system to surround the target, the moderator-reflector system having at least one moderator and a reflector surrounding the moderator and the target, and producing at least one moderated neutron beam of a second impulse length with the at least one moderator from the neutrons produced in the target, and chopping the at least one moderated neutron beam in time according to a pattern selected from a random and a pseudo-random pattern, thereby producing a neutron beam modulated in time according to a selected pattern and containing impulses of at least 50 times shorter impulse lengths than the second impulse length.

11. The method according to claim 10, characterised by producing the first proton beam with a first impulse length of 0.5-5 ms.

12. The method according to claim 10, characterised by performing time of flight measurement on the modulated neutron beam, correlating the measurement result with the modulation function of the pseudo-random pattern, and determining the time of flight spectrum of the at least one moderated neutron beam from this.

13. The method according to claim 10, characterised by chopping the at least one moderated neutron beam with a chopper placed in the trajectory of the at least one moderated neutron beam and operating with electrically generated impulses, with which a random or pseudo-random modulation pattern is created consisting of time intervals during which the neutron beam is allowed to pass or is substantially blocked.

14. The method according to claim 10, characterised by chopping the at least one moderated neutron beam with a statistical neutron chopper comprising a rotatable disc that has radial slits forming a pseudo-random pattern and which is positioned in the trajectory of the at least one moderated neutron beam and rotating the disc at an angular speed so that the moderated neutron beam to be modulated is permitted to pass through the slits for a time corresponding to a whole number multiple of a time interval falling between 15-50 μs.

15. The method according to claim 14, characterised by rotating the disc at an angular speed so that the moderated neutron beam to be modulated is permitted to pass through the slits for a time corresponding to a whole number multiple of a time interval falling between 15-50 μs.

16. The method according to claim 14, characterised by placing at least one statistical neutron chopper in the trajectory of at least two moderated neutron beams, and simultaneously modulating at least two moderated neutron beams.

* * * * *